US008393369B2

(12) United States Patent
Ballarotti

(10) Patent No.: US 8,393,369 B2
(45) Date of Patent: Mar. 12, 2013

(54) LABELING MACHINE FOR LABELS PRINTED ON CONTINUOUS FILM

(75) Inventor: Mario Ballarotti, Marmirolo (IT)

(73) Assignee: P.E. Labellers S.p.A., Porto Mantovano (IT)

( * ) Notice: Subject to any disclaimer, the term of this patent is extended or adjusted under 35 U.S.C. 154(b) by 270 days.

(21) Appl. No.: 12/742,132

(22) PCT Filed: Oct. 22, 2008

(86) PCT No.: PCT/EP2008/064260

§ 371 (c)(1),
(2), (4) Date: May 10, 2010

(87) PCT Pub. No.: WO2009/068372

PCT Pub. Date: Jun. 4, 2009

(65) Prior Publication Data

US 2010/0252201 A1 Oct. 7, 2010

(30) Foreign Application Priority Data

Nov. 30, 2007 (IT) ..... MN2007A0043

(51) Int. Cl.
*B65C 9/18* (2006.01)
*B65C 9/20* (2006.01)
*B65H 59/38* (2006.01)

(52) U.S. Cl. ..... 156/361; 156/486; 156/494; 156/541; 156/568; 242/419.3

(58) Field of Classification Search ..... 242/416, 242/417.1, 417, 419.3
See application file for complete search history.

(56) References Cited

U.S. PATENT DOCUMENTS

| | | | | |
|---|---|---|---|---|
| 2,642,200 | A * | 6/1953 | Gehring | 156/534 |
| 3,594,257 | A | 7/1971 | Von Hofe | |
| 3,948,425 | A * | 4/1976 | Bala | 226/43 |
| 4,366,023 | A | 12/1982 | Voltmer | |
| 5,702,559 | A | 12/1997 | Bright | |
| 5,753,350 | A | 5/1998 | Bright | |
| 5,922,169 | A | 7/1999 | Chodacki et al. | |
| 6,095,218 | A | 8/2000 | Delmolino et al. | |
| 6,832,831 | B2 | 12/2004 | Shima et al. | |
| 2002/0179767 | A1 * | 12/2002 | Rapparini | 242/417.1 |

FOREIGN PATENT DOCUMENTS

| | | |
|---|---|---|
| JP | S61143848 | 9/1986 |
| JP | H05170238 | 7/1993 |
| JP | H07033812 | 6/1995 |
| JP | H11-509643 | 8/1999 |
| JP | 2003095237 | 4/2003 |

(Continued)

OTHER PUBLICATIONS

Japanese Office Action, Nov. 19, 2012.

*Primary Examiner* — Barbara Musser
(74) *Attorney, Agent, or Firm* — Greer, Burns & Crain Ltd.

(57) ABSTRACT

A labeling machine for labels printed on continuous film, comprising, in an intermediate position between a motorized reel and a feed roller, a tunnel provided with suction elements adapted to determine on the film in transit inside it an attraction that gives it a bent configuration, elements being provided which are adapted to control the depth of the bend, the tunnel being provided with a bottom and a lid that are adapted to align the film at a constant height.

7 Claims, 3 Drawing Sheets

FOREIGN PATENT DOCUMENTS

| | | |
|---|---|---|
| JP | 2003291445 | 10/2003 |
| JP | 2005033812 | 2/2005 |
| WO | 9702949 | 1/1997 |
| WO | 9903737 | 1/1999 |

* cited by examiner

LABELING MACHINE FOR LABELS PRINTED ON CONTINUOUS FILM

TECHNICAL FIELD

The present invention relates to a labeling machine for labels printed on continuous film.

BACKGROUND ART

It is known that there are labeling machines designed to process labels printed on a continuous film that is unwound from a motorized reel, and that said film can be pre-pasted, i.e., provided with paste, at one face, or not, and in this case suitable pasting means are provided within the machine.

Such labeling machines comprise a drum that accompanies the film, retaining it so that it adheres to the surface by way of suction generated at the surface, cutting the individual labels up to being applied to corresponding containers conveyed by conveyance means, which are commonly constituted by a rotating carousel.

The film of the labels is fed to the drum by means of a feed roller, which, in order to be able to work correctly at the high speeds currently required, needs to receive the film unwound from the reel in extremely low and constant tension conditions, the film being further aligned at a constant height.

For this purpose, the background art provides for the presence of tensioning devices combined with alignment devices, which however are not entirely satisfactory.

DISCLOSURE OF THE INVENTION

Therefore the aim of the present invention is to provide a labeling machine in which the arrival of the film of the labels to the feed roller is ensured in such conditions as to ensure optimal operation of the roller.

The above aim and other objects which will become better apparent hereinafter are achieved by a labeling machine for labels printed on continuous film, according to the invention, comprising a feed roller that conveys the film of the labels from a motorized reel to a drum that accompanies the film, cutting the individual labels, up to being brought to application on corresponding containers supported by conveyance means, characterized by the presence, in a position comprised between said motorized reel and said feed roller, of a tunnel provided with suction means adapted to determine on the film in transit inside it an attraction that gives it a bent configuration, means being provided which are adapted to control the depth of said bend, and said tunnel being provided with a bottom and a lid that are adapted to align the film at a constant height.

BRIEF DESCRIPTION OF THE DRAWINGS

Further characteristics and advantages of the present invention will become better apparent from the description of two preferred but not exclusive embodiments thereof, illustrated by way of non-limiting example in the accompanying drawings, wherein.

DESCRIPTION OF THE PREFERRED EMBODIMENTS

Figure 1:
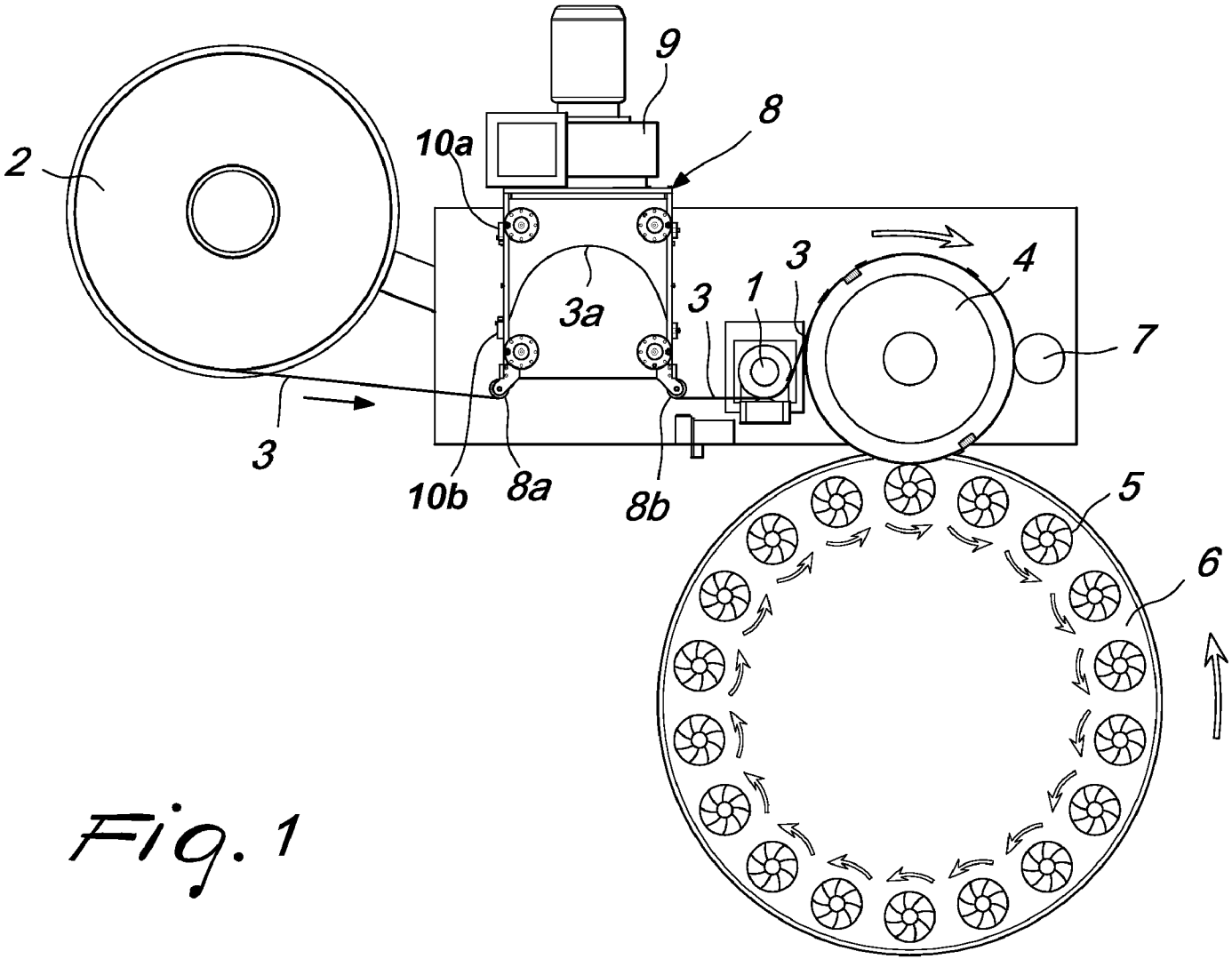
FIG. 1 is a schematic plan view of the labeling machine according to the invention.
Figure 3:
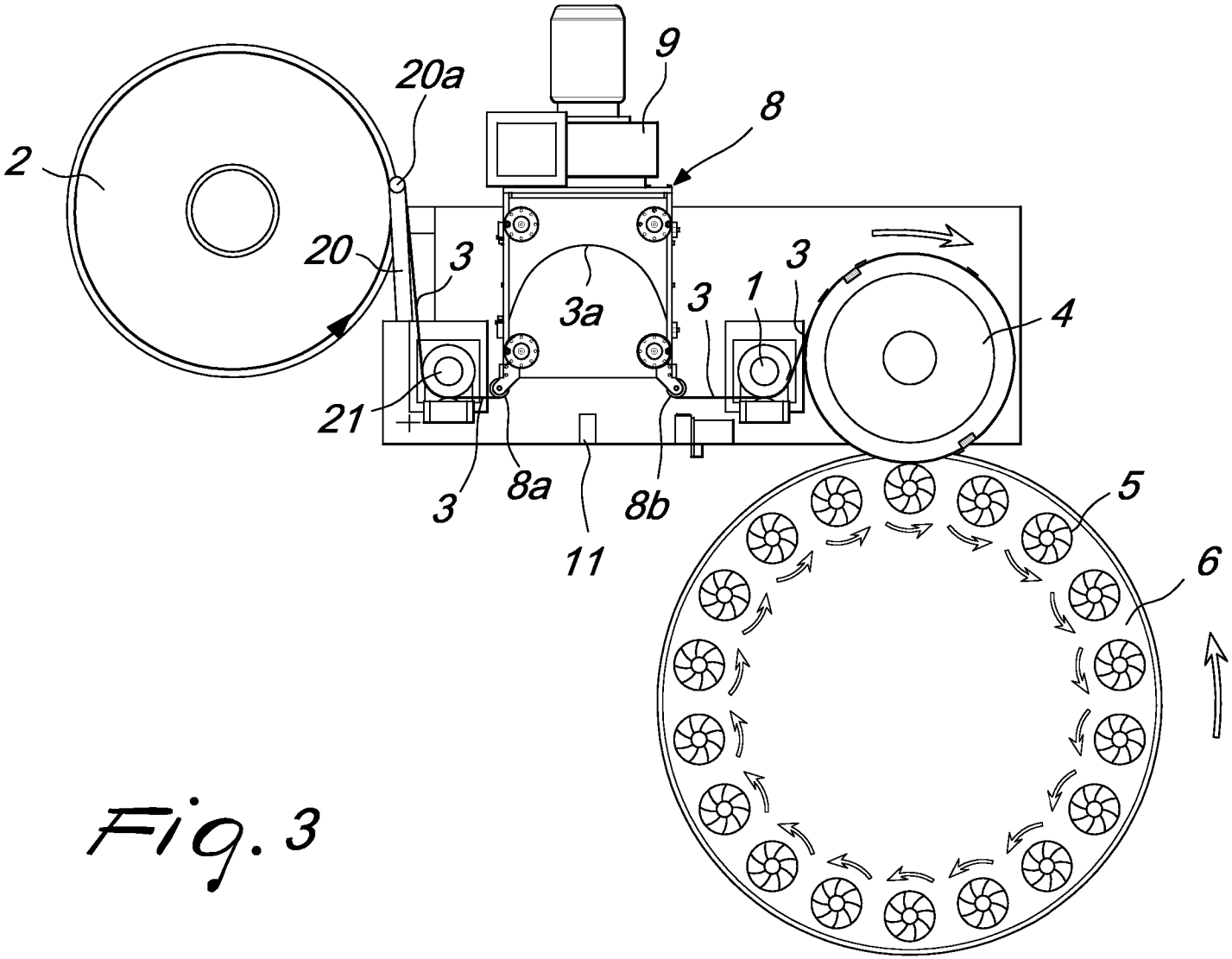
FIG. 3 is a schematic plan view according to another embodiment of the labeling machine according to the invention.

It should be specified that the embodiment shown in FIG. 1 is designed to process a film of labels that is not pre-pasted, while the embodiment of FIG. 3 is designed to process a pre-pasted film, and that both comprise a feed roller 1 that conveys from a motorized reel 2 the film of the labels 3 to a drum 4 that accompanies the film, cutting the individual labels up to being applied to individual containers 5 conveyed by a rotating carousel 6.

In the case of the machine of FIG. 1, which processes a film of labels that is not pre-pasted, means 7 for pasting the film 3 are provided, which obviously are absent in the case of the machine of FIG. 3, which processes pre-pasted films.

Figure 2:
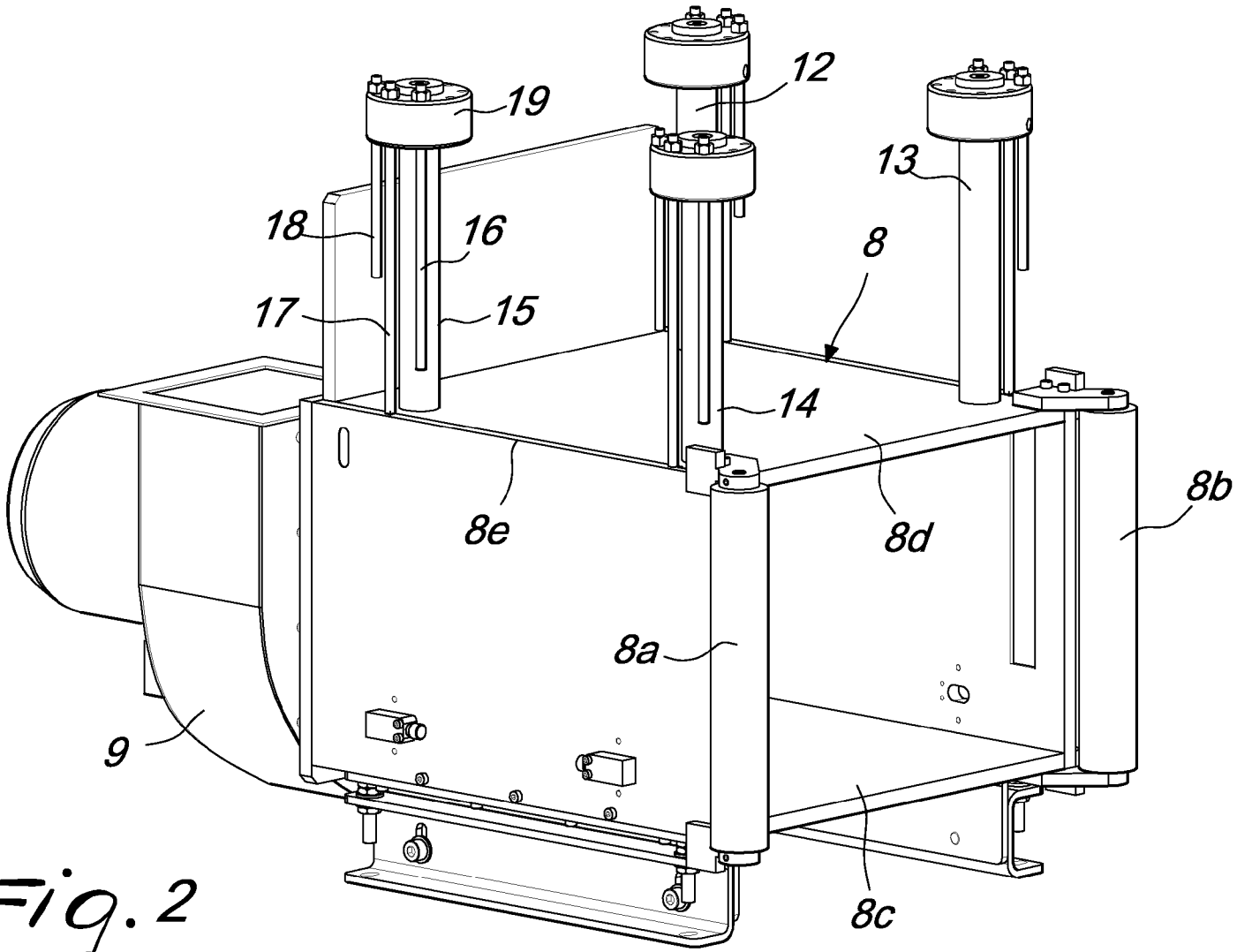
FIG. 2 is a view of the detail of the tunnel.

In both embodiments of FIGS. 1 and 3, in a position that directly precedes the feed roller 1, there is a tunnel, generally designated by the reference numeral 8, that is described in detail with particular reference to FIG. 2.

Tunnel 8 is provided with suction means, which comprise a fan 9 and are adapted to provide on the film of labels in transit within it, between the input roller 8*a* and the output roller 8*b*, an attraction that is such as to induce it to arrange itself along a bend 3*a*, whose depth is controlled by way of appropriate means that are adapted to send signals to the control electronics of the machine.

Such means comprise, in the embodiment of FIG. 1, two photocells 10*a*, 10*b*, which are conveniently spaced in the direction of the axis of symmetry of the loop, and instead comprise, in the embodiment of FIG. 3, only a photocell 11 located at the plane of symmetry of the loop; of course, the described means are interchangeable between the two embodiments.

The presence of the tunnel 8 according to the invention ensures occurrence of the condition in which the film of labels 3 reaches the feed roller 1 in the conditions of extremely low and constant tension that are required for optimum operation; moreover, the tunnel provides, by means of its bottom 8*c* and its lid 8*d*, a guide at the respectively lower and upper edges of the film 3 that ensures perfect alignment at a constant height.

In order to obtain such a flexibility of operation of the tunnel as to allow to change the format of the labels being processed, the lid 8*d* is provided with means that are adapted to determine the arrangement thereof at a variable height from the bottom 8*c*, without altering the fact that if the format change is not intended, the lid is at a fixed height.

Such means thus comprise four columns 12, 13, 14, 15, which are jointly connected to the lid 8*d* and are provided with identical equipment, and therefore only the column 15 will be described in detail.

The column 15 is provided with three rods 16, 17, 18 of different lengths, which are applied in an adjustable manner to a rotatable support 19, such rods being adapted to rest selectively at the end, as a consequence of the rotation of the support 19, on a fixed frame 8*e* of the lid 8*d*.

In the situation of FIG. 2, the longer rods 17, of the four columns rest on the frame 8*e*, and accordingly the lid 8*d* is at the highest level; to lower it for example by a first extent, it is sufficient to rotate the supports 19 and bring the intermediate-length rods 16 of the four columns to rest with the edge 8*e*, and a further lowering can be obtained by making the shorter rods 18 rest on such edge.

Whereas in the case of the machine of FIG. 1, designed to process a film that is not pre-pasted, the tunnel 8 is arranged directly adjacent to the reel 2, from which the film 3 unwinds, the machine of FIG. 3 that processes a pre-pasted film comprises means that are interposed between the reel 2 and the tunnel 8 and are adapted to facilitate removal of the film 3 from the reel in order to prepare it for the action of the tunnel.

Such means comprise an arm 20, in which the end provided with a roller 20*a* is retained, by elastic means not shown in the figure, in contact with the surface that is not pre-pasted of the film 3 in the region where the film begins to separate from the reel, and a takeup roller 21 acts on the film at the portion comprised between the arm 20 and the access to the tunnel 8.

The described invention is susceptible of numerous modifications and variations, all of which are within the scope of the appended claims; all the details may further be replaced with other technically equivalent elements.

The disclosures in Italian Patent Application No. MN2007A000043 from which this application claims priority are incorporated herein by reference.

The invention claimed is:

1. A labeling machine for labels printed on continuous film, comprising:

a motorized reel for supporting a film of labels;

a drum for cutting individual labels of the film;

a feed roller for conveying the film of the labels from said motorized reel to said drum;

a rotating carousel for supporting containers and arranged to receive the cut individual labels from said drum and to apply the individual labels to said containers;

a tunnel arranged between said motorized reel and said feed roller for transit in said tunnel of said film of labels;

suction means for said tunnel adapted to give the film in transit inside said tunnel a bent configuration into a loop;

means for controlling a depth of said loop inside said tunnel;

said tunnel being provided with a bottom and a lid that are adapted to align the film at a constant height inside said tunnel; and a plurality of columns that are connected to the lid and are provided with rods of different lengths which are applied adjustably to a rotatable support that is located at a top of said columns, said rods being adapted to rest selectively on a fixed frame of said lid.

2. The machine according to claim 1, wherein the suction means comprise a fan applied to an end wall of said tunnel.

3. The machine according to claim 1, wherein the means for controlling the depth of said loop comprise two photocells that are mutually spaced in a direction parallel of an axis of symmetry of said loop.

4. The machine according to claim 1, wherein the means for controlling the depth of the said loop comprise a photocell located at a plane of symmetry of said loop.

5. The machine according to claim 1, further comprising means for pasting said film, and wherein the tunnel is arranged adjacent to the motorized reel of said film.

6. The machine according to claim 1, further comprising takeup means that are interposed between the motorized reel of said film and the tunnel for takeup of said film from the reel so as to prepare said film for the tunnel.

7. The machine according to claim 1, further comprising takeup means that are interposed between the motorized reel of said film and the tunnel for takeup of said film from the reel so as to prepare said film for the tunnel, said takeup means comprising an arm which has a rounded end kept in contact with a non-pasted surface of the film in a region where said film begins to separate from the reel, and a takeup roller that acts on the film at an area comprised between said arm and an access to the tunnel.

* * * * *